US005117941A

United States Patent [19]

Gruber

[11] Patent Number: 5,117,941

[45] Date of Patent: Jun. 2, 1992

[54] LADDER BRACKET

[76] Inventor: Eugene Gruber, 1506 King St. West, Apt. 5, Toronto, Ontario M6K 1J5, Canada

[21] Appl. No.: 678,393

[22] Filed: Apr. 1, 1991

[51] Int. Cl.[5] ..... E06C 7/48

[52] U.S. Cl. ..... 182/107; 182/214; 248/210

[58] Field of Search ..... 182/107, 108, 214, 185; 248/210

[56] References Cited

U.S. PATENT DOCUMENTS

| | | | |
|---|---|---|---|
| 3,181,651 | 5/1965 | Larson | 182/228 |
| 3,419,109 | 12/1968 | Costlow | 182/214 |
| 3,734,236 | 5/1973 | Houtler, et al. . | |
| 3,773,143 | 11/1973 | Del Prete et al. . | |
| 3,853,202 | 12/1974 | Jarboe et al. . | |
| 4,061,203 | 12/1977 | Spencer et al. . | |
| 4,159,045 | 6/1979 | Brooks | 182/214 |
| 4,194,592 | 3/1980 | Evans . | |
| 4,280,590 | 7/1981 | Polizzi . | |
| 4,311,210 | 1/1982 | Jackson . | |
| 4,331,217 | 5/1982 | Stecklow . | |
| 4,339,020 | 7/1982 | Wiseman | 182/214 |
| 4,359,138 | 11/1982 | Kummerlin et al. . | |
| 4,412,599 | 11/1983 | McCrudden et al. . | |
| 4,440,263 | 4/1984 | Smith . | |
| 4,444,291 | 4/1984 | McPherson . | |
| 4,491,192 | 1/1985 | Skarsten . | |
| 4,502,566 | 3/1985 | Wing . | |
| 4,580,660 | 4/1986 | Oling . | |
| 4,754,842 | 7/1988 | Southern . | |
| 4,771,862 | 9/1988 | Garland . | |
| 4,823,912 | 4/1989 | Gould | 182/214 |
| 4,880,079 | 11/1989 | Leclerc . | |
| 4,899,848 | 2/1990 | Parr . | |

*Primary Examiner*—Reinaldo P. Machado

[57] ABSTRACT

A pair of brackets for the top end of a ladder, which can be slipped over the ladder rails and pinned in attached relation thereto, are of light weight, low cost pressed steel construction, and are formed to accept as a spacer member a piece of two-by-four timber, to permit supporting the ladder against the face of a building such as a damage-susceptible siding, or in positioned relation in a window opening, wherein the two-by-four timber spans the window opening and supports the ladder in that opening. An alternative use of the brackets, in one embodiment in combination with a small plywood platform attached to the brackets, serves as a ladder hold-off, for use when working under or adjacent the eaves of a house, and to serve as a supporting platform for a can of paint, or other adjuncts such as tools. The form of the brackets facilitates readily manufacture from sheet steel, with high percentage material utilization, and low scrap generation.

19 Claims, 3 Drawing Sheets

LADDER BRACKET

TECHNICAL FIELD

This invention is directed to an auxiliary ladder bracket, and in particular to a pair of bracket members for mounting on a ladder to attach a spacer member in secured relation to the ladder.

BACKGROUND ART

The use of auxiliary spacer members with ladders, to facilitate the positioning of the ladder upper end against a wall or like construction, is very well known.

A wide range of patents are to be found which are directed to the same purposes, in general fashion, as the present invention. While certain of these patents disclose apparatus providing the same or similar function to the present invention, the apparatus are quite differently constructed.

The list of patents compries: U.S. Pat. No. 4,311,210 to Jackson U.S. Pat. No. 4,412,599 to McCrudden et al. U.S. Pat. No. 4,754,842 to Southern U.S. Pat. No. 3,773,143 to Del Prete et al. U.S. Pat. No. 4,061,203 to Spencer et al. U.S. Pat. No. 4,440,263 to Smith U.S. Pat. No. 4,502,566 to Wing U.S. Pat. No. 4,734,236 to Houtler U.S. Pat. No. 4,194,592 to Evans U.S. Pat. No. 4,159,045 to Brooks U.S. Pat. No. 4,280,590 to Polizzi U.S. Pat. No. 4,331,217 to Stecklow U.S. Pat. No. 4,339,020 to Wiseman U.S. Pat. No. 4,359,138 to Kummerlin et al. U.S. Pat. No. 4,823,912 to Gould et al. U.S. Pat. No. 3,853,202 to Jarboe U.S. Pat. No. 4,444,291 to McPherson U.S. Pat. No. 4,491,192 to Skarsten U.S. Pat. No. 4,580,660 to Oling U.S. Pat. No. 4,771,862 to Garland U.S. Pat. No. 4,880,079 to Leclerc U.S. Pat. No. 4,899,848 to Parr Most of the prior art ladder attachment embodiments are complex, heavy and clumsy, difficult and time consuming to attach and detach from a ladder, and expensive to produce.

DISCLOSURE OF INVENTION

The present invention is directed to a pair of brackets that are preferably handed, left and right, for mounting upon the side rails of a ladder, in secured relation thereto, to receive a hold-off member such as a two-by-four, or a rectangular piece of plywood in attached relation to the brackets.

The brackets are characterized by light-weight, low cost construction of high strength, adapted for use in combination with commonly available construction site materials as the hold-off member, described above. This facilitates the use of the brackets, a pair or pairs of which may be conveniently carried in a user's toolbag or car, and made up as a hold-off platform on site, by use of locally available lumber, commonly found at building sites.

The construction of the subject bracket from galvanized steel sheet may be readily carried out using basic sheet metal working tools, such as dies to stamp out the plate profile for the brackets, a brake press for bending certain portions of the brackets, and simple assembly means.

The basis of each bracket is a web plate, to which the auxiliary wood hold-off members are secured.

The web plate itself is prepared for receiving the side rails of a ladder in attached relation thereto by the provision for each bracket of a tube-like portion or hollow box section within which the top end of the ladder side rail is entered. The tube-like, box section side rail entry portion may be formed by use of a press brake acting on the web plate to form the form sides, and by attachment of the free side of the web plate in welded closing relation to form a closed, four sided tube or box-section.

Alternatively, the web plate may have a two sided or a three sided channel member secured thereto, to form a four sided box channel into which an end of the ladder side rail can be entered. This latter arrangement permits fabrication of the bracket without Welding, by the provision of securing tabs extending from the channel sides, which are bent over after assembly. The latter arrangement is of particular value in that it permits up to about 97% utilization of the galvanized steel sheet stock from which the brackets are made. This contrasts with a 75% sheet utilization for one piece brackets, which generally also require to be completed by a welding process, to close the box-section tube.

The present invention thus provides a ladder bracket for attachment as one of a pair to a free end portion of a ladder side rail, the bracket having a substantially plane web portion, a hollow box-section extending therefrom to receive an end of a ladder rail in entered relation therein, and flange means extending laterally of the web portion for attachment, in use, of a spacing member thereto in secure attached relation to the bracket.

The flange means comprises an edge portion or portions of the web, formed at right angles thereto, to provide stiffening to the web and an attachment surface to receive a spacing member in secured relation therewith.

A particular advantage of the separate box section construction is that stamped-out bracket components are universal, being neither right or left handed, while permitting the manufacture of "handed" brackets by assembling the U-section box sides to one side or to the opposite side of the web plate, in accordance with the "handing" that may be required.

It will be understood, in a further embodiment, that the web portion of the bracket may be formed to provide two adjoining sides of the hollow box-section. The complementary box portion then comprises two sides that form an L-section, having tabs for attachment in joined relation to the web portion of the bracket that forms the complementary sides.

The subject brackets may be removably secured to the side rails of the ladder by an insert pin. A first aperture may be drilled through the box side or sides of the bracket located in facing relation with the side of the ladder rail, and a second aperture corresponding thereto may be drilled through the side of the ladder rail in adjoined relation with the bracket aperture(s), to receive a locking pin in entered, removable relation with the bracket.

In an alternative embodiment, the first aperture in the box side may be located on a downwardly extended box side portion, in aligned relation with the hollow rung interior of an aluminum ladder, into which the locking pin may then project, to secure the bracket in locked relation with the ladder rail.

The flange portion of the bracket may comprise the top edge of the bracket web, extending in inclined relation from the hollow box-section, to provide a substantially horizontal attachment surface for the spacing member when in use, with the ladder rail inclined in a stable working position. In this instance, the spacing member may comprise a plywood platform.

The flange portions of the bracket web may include one or more front edge portions of the web, lying in substantially vertical or horizontal planes when the ladder is erected in an inclined working position, the flange portion or portions adjoining a three sided recess, to receive a length of rectangular section timber in inserted relation therein.

The flange portions extend parallel with the recess sides and may have apertures therethrough to permit the insertion of fastening nails or screws in retaining relation into the timber spacing member, when inserted into the recess.

In one preferred embodiment the rectangular section recess is sized to accommodate a "two-by-four" piece of joist in inserted fitting relation therein.

While the preferred use of the brackets are as pairs of oppositely handed brackets, it will be recognized that the arrangement of the brackets are such that they may be readily used without being so handed. The slight asymetry resulting from such undifferentiated use does not normally compromise the integrity or utility of the combination thus produced.

BRIEF DESCRIPTION OF DRAWINGS

Certain embodiments of the present invention are described by way of illustration, without limitation of the invention thereto, reference being made to the accompanying drawings, wherein.

BEST MODE OF CARRYING OUT THE INVENTION

Figure 1:
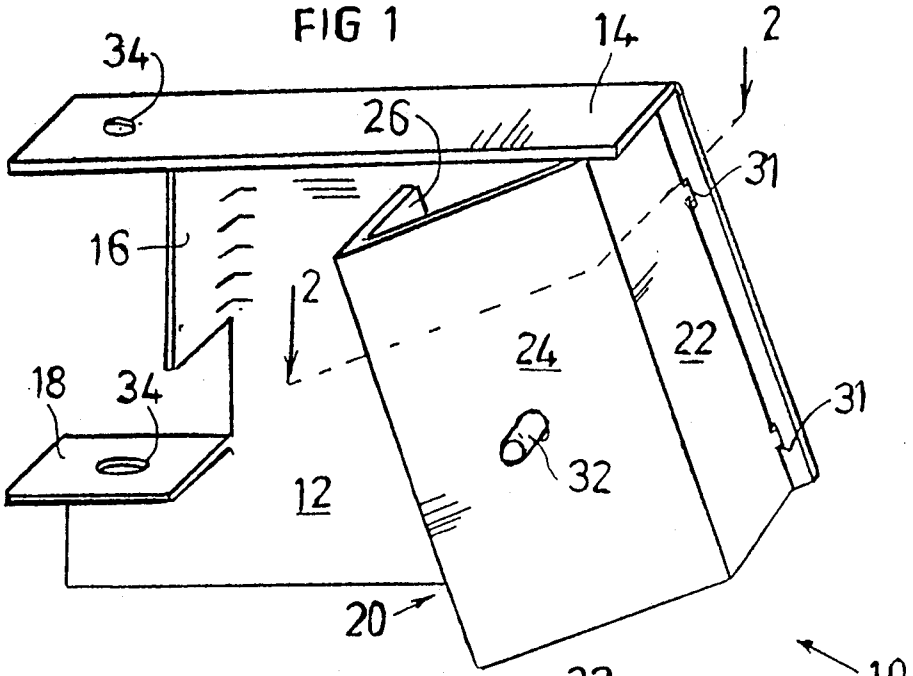
FIG. 1 is a perspective side view of a first bracket in accordance with the invention.
Figure 2:
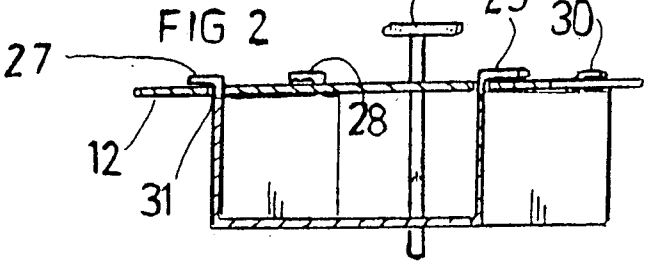
FIG. 2 is a partial inclined section taken at 2—2 of FIG. 1.

Referring to FIGS. 1 and 2 the bracket 10 has a web portion 12, a top flange portion 14 and front flange portions 16, 18.

A hollow box section portion 20 comprises U-section box walls 22, 24, 26 secured by tab portions 27, 28, 29, 30 entered through slots 31 in the Web portion 12, and bent over as shown in FIG. 2 to form permanent fasteners.

A retaining pin 32 extends through the web portion 12 and the opposing box wall 24, in inserted, withdrawable relation.

Figure 3:
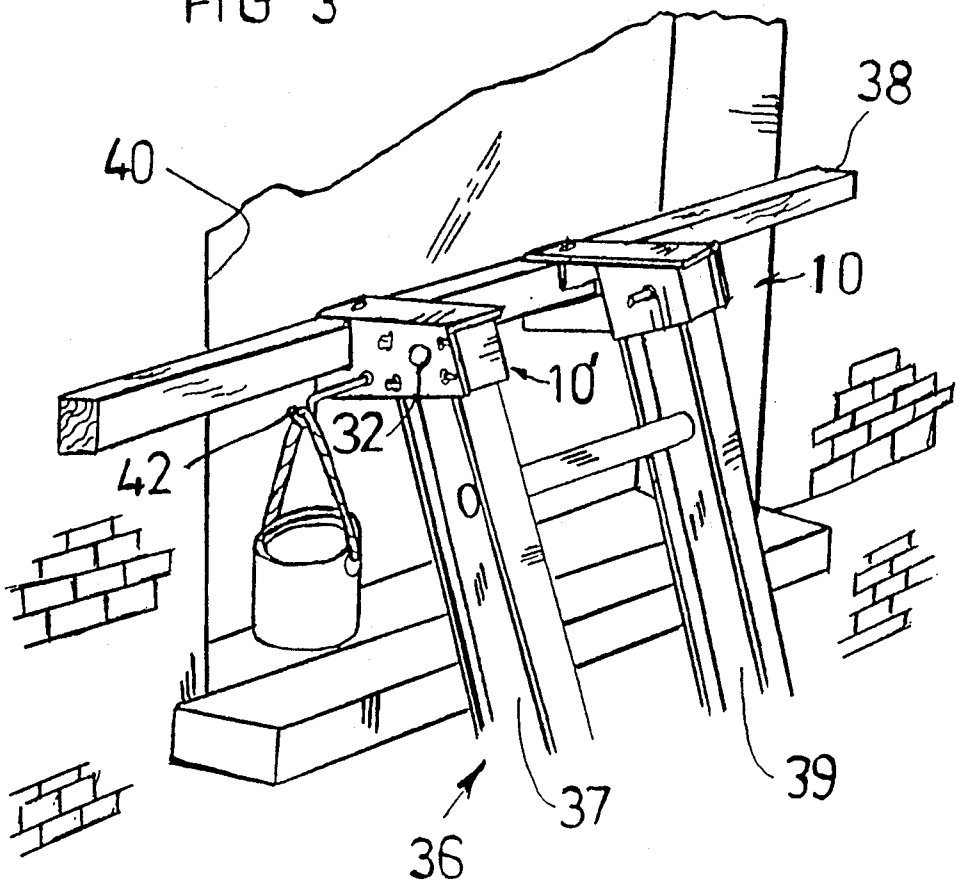
FIG. 3 is a perspective elevation view of a pair of brackets of FIG. 1 embodiment, in use with an elongated spacing member.

The flange portion 18 and the front of top flange 14 have apertures 34 to receive a screw or nail in inserted fastening relation therein to hold a spacing member two-by-four timber, or the like, in secured relation with the bracket 10, as seen in FIG. 3.

Referring further to FIG. 3 a ladder 36 has a handed (left and right) pair of brackets 10, 10' secured thereto by retaining pins 32, for which the side rails 37, 39 are appropriately drilled.

The "two-by-four" timber 38 (i.e. $3\frac{1}{2} \times 1\frac{1}{2}$ inch finished size) is secured by screws or nails, being of a size to span a required opening such as the illustrated window aperture 40.

A hook 42 extending from one or other of the brackets can hold a can of paint or a tool receptacle.

In addition to spanning a window or other gap, the two-by-four timber, as illustrated or as a shorter length may be used against vinyl or aluminum siding sheets, to avoid marking or other damage to the building face.

Figures 4, 5:
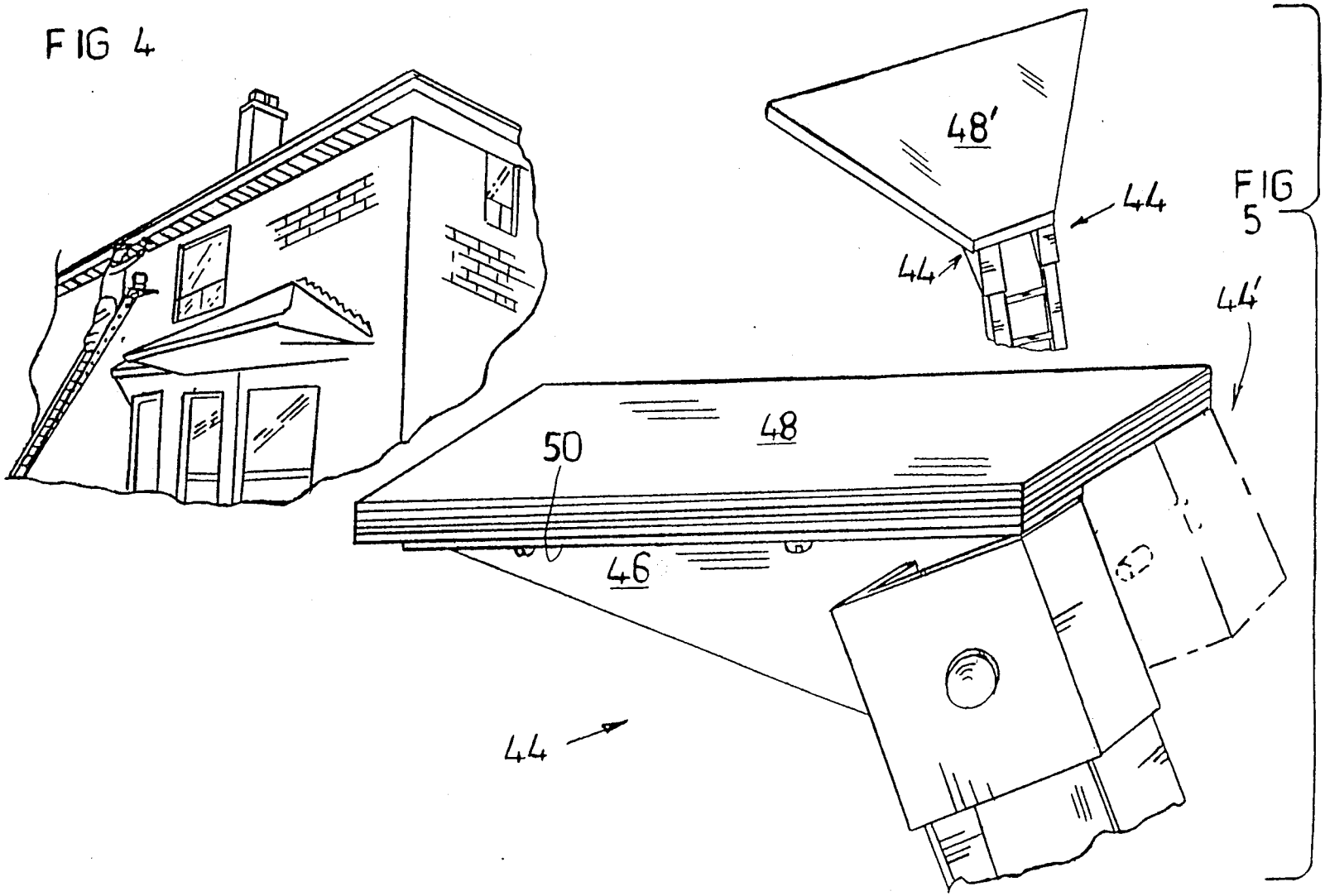
FIG. 4 is a distant perspective view showing the use of a ladder having a pair of brackets with a plywood working platform attached thereto as the spacing member.
FIG. 5 is an enlarged side perspective view of a bracket for the FIG. 4 platform embodiment.

FIGS. 4 and 5 show platform type brackets 44, having an extended web portion 46, with a platform 48 or 48' secured thereto by way of the long top flange 50. The presence of a second bracket 44' is indicated in chain dotted line.

Figure 6:
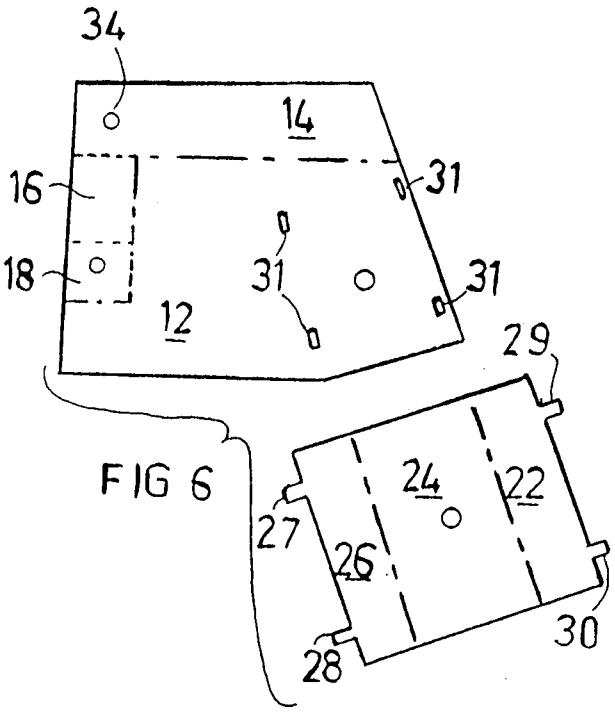
FIG. 6 is a reduced size plan view of the component parts of the FIG. 1 embodiment.

FIG. 6 shows the sheet steel component parts of the FIG. 1 embodiment, wherein cut lines are shown dotted, and bend (brake) lines are chain dotted. In use the platform 48 serves as a stand-off support, to distance the head of the ladder from the supporting wall. The platform 48 may contain a can of paint, tools and the like.

The use of stand off platform 48 facilitates access to the working zone beneath the eaves, as illustrated in FIG. 4, and also facilitates safe working access to the eaves trough and the roof area thereabove.

INDUSTRIAL APPLICABILITY

The ladder attachment brackets are a most useful, low cost ancilliary bracket to extend the safe utilization of ladders, domestically and commercially.

What is claimed:

1. A ladder bracket for attachment as one of a pair to a free-end portion of a ladder rail, said bracket being of unitary construction, having a substantially plane web portion, a contiguous hollow box-section permanently secured thereto and extending laterally therefrom to receive said rail in entered relation therein, and contiguous flange means extending normally of said web portion and extending forwardly of said box section for attachment of a spacing member in secured relation to the bracket.

2. The bracket as set forth in claim 1, at least one edge portion of said box-section being attached to said web portion.

3. The bracket as set forth in claim 2, said attached box-section portion comprising at least two side of said box-section.

4. The bracket as set forth in claim 2, said attached box-section portion comprising three sides of said box-section.

5. The bracket as set forth in claim 1 wherein said web portion is of metal plate.

6. The bracket as set forth in claim 5 wherein said web portion is of sheet metal.

7. The bracket as set forth in claim 1, at least one side of said box-section being secured by a deformed tab to said web portion.

8. The bracket as set forth in claim 1, at least one side of said box-section being welded along at least a portion of its length to said web portion.

9. The bracket as set forth in claim 1, said box section having an aperture in at least one side thereof, in use to receive a bracket locating pin in entered relation therein.

10. The bracket as set forth in claim 1, said web portion extending in elongated relation from said box-section, having said flange means extending substantially normally to an elongated edge of said web portion.

11. The bracket as set forth in claim 1, in combination with a like bracket, in assembled relation with said spacing member.

12. The combination as set forth in claim 11 wherein said spacing member comprises a length of two-by-four timber secured to said bracket.

13. The combination as set forth in claim 11 wherein said spacing member comprises a rectangle of sheething material, said flange means extending normally from an elongated edge portion of said web portion, in secured, supporting relation with said sheething material.

14. The combination as set forth in claim 11, including pin means inserted at least partially through said box-section, in use to secure said combination in locked relation with said ladder.

15. A ladder bracket for attachment as one of a pair to a free-end portion of a ladder rail, said bracket having a substantially plane web portion, a hollow box-section extending therefrom to receive said rail in entered relation therein, and flange means including a pair of flange portions extending in mutually parallel spaced relation, in use to receive a spacing member in entered relation therein for attachment of said spacing member in secured relation to the bracket.

16. The bracket as set forth in claim 15, at least one of said flange portions having an aperture therein for the insertion therethrough, in use, of fastening means in securing relation with said spacing member.

17. The bracket as set forth in claim 15, said web portion having a recess therein on a side remote from said box-section, said recess being of a size to receive a piece of two-by-four timber in entered relation therein, in laterally extending relation with said web portion.

18. The bracket as set forth in claim 17, said flange means including at least one flange portion adjoining said recess; said flange portion having an aperture therethrough, in use to receive fastening means in securing relation with said spacing member.

19. The ladder bracket as set forth in claim 15, wherein said flange means includes an upper portion extending laterally of said web portion across one end of said hollow box section, in substantially end closing relation therewith, in use to receive an upper end portion of a ladder side rail in positively positioned relation therein.

* * * * *